US008905090B2

(12) United States Patent
Trebbi et al.

(10) Patent No.: US 8,905,090 B2
(45) Date of Patent: Dec. 9, 2014

(54) APPARATUS AND METHOD FOR FEEDING A PACKAGING MACHINE WITH A PRODUCT

(75) Inventors: Claudio Trebbi, Medicina (IT); Alessandro Bisi, Argelato (IT)

(73) Assignee: Ima Life S.R.L., Ozzano Dell'Emilia (Bologna) (IT)

( * ) Notice: Subject to any disclaimer, the term of this patent is extended or adjusted under 35 U.S.C. 154(b) by 1227 days.

(21) Appl. No.: 12/296,161

(22) PCT Filed: Apr. 4, 2007

(86) PCT No.: PCT/IB2007/000887

§ 371 (c)(1),
(2), (4) Date: Jan. 16, 2009

(87) PCT Pub. No.: WO2007/113661

PCT Pub. Date: Oct. 11, 2007

(65) Prior Publication Data

US 2009/0120041 A1 May 14, 2009

(30) Foreign Application Priority Data

Apr. 5, 2006 (IT) ..... BO2006A0246

(51) Int. Cl.

| | |
|---|---|
| ***B65B 37/00*** | (2006.01) |
| ***B65B 1/08*** | (2006.01) |
| ***B65B 43/42*** | (2006.01) |
| ***B65B 1/04*** | (2006.01) |
| ***B65B 69/00*** | (2006.01) |
| ***B65B 3/00*** | (2006.01) |

(52) U.S. Cl.

CPC ..... *B65B 3/003* (2013.01); *B65B 37/00* (2013.01); *B65B 69/00* (2013.01)

USPC ..... 141/233; 141/68; 141/151; 141/319; 141/329

(58) Field of Classification Search

USPC ..... 141/1, 148, 231, 329, 67, 68, 151, 232, 141/233, 319; 53/459; 198/358; 414/403–415, 418–425, 810, 811, 414/416.01–416.12, 292

See application file for complete search history.

(56) References Cited

U.S. PATENT DOCUMENTS 4,304,224 A * 12/1981 Fortney ..... 600/21
4,347,874 A 9/1982 Sullivan et al.

(Continued)

FOREIGN PATENT DOCUMENTS

DE 26 19 765 11/1977
DE 2619765 A * 11/1977 ..... B65B 1/06

(Continued)

OTHER PUBLICATIONS

International Search Report for PCT/IB2007/000887, mailed Jan. 29, 2008.

(Continued)

*Primary Examiner* — Jason Boeckmann
*Assistant Examiner* — Steven M Cernoch
(74) *Attorney, Agent, or Firm* — Nixon & Vanderhye P.C.

(57) ABSTRACT

An apparatus for feeding a product to be packaged to a packaging machine provided with a dosing unit, comprises a lifting arrangement suitable for lifting and moving at least a container of the product in such a way as to connect the container to the dosing unit to transfer thereto the product contained in the container; a method for feeding a product to be packaged to a packaging machine provided with a dosing unit by the apparatus, comprises the steps of introducing a container of product inside the apparatus, fixing the container to a lifting arrangement of the apparatus, moving the container using the lifting arrangement in such a way as to connect it to the dosing unit, transferring the product contained in the container to the dosing unit.

15 Claims, 13 Drawing Sheets

(56) References Cited

U.S. PATENT DOCUMENTS

| | | | | | |
|---|---|---|---|---|---|
| 4,706,551 | A | * | 11/1987 | Schofield | 454/66 |
| 4,752,807 | A | * | 6/1988 | Mort | 399/106 |
| 4,869,156 | A | * | 9/1989 | Hutton | 454/187 |
| 4,942,432 | A | * | 7/1990 | Mort et al. | 399/106 |
| 5,484,004 | A | | 1/1996 | Bolz | |
| 5,735,321 | A | | 4/1998 | Martyn et al. | |
| 6,517,306 | B1 | * | 2/2003 | Budny et al. | 414/420 |
| 6,986,632 | B2 | * | 1/2006 | Spatafora et al. | 414/421 |
| 7,094,015 | B2 | * | 8/2006 | Hohmann et al. | 414/404 |
| 2003/0173478 | A1 | * | 9/2003 | Williams et al. | 248/176.1 |

FOREIGN PATENT DOCUMENTS

| | | |
|---|---|---|
| EP | 0 659 683 | 6/1995 |
| JP | 06-211202 | 8/1994 |
| JP | 8-175673 | 7/1996 |
| JP | 2007-69915 | 3/2007 |

OTHER PUBLICATIONS

Office Action issued in Japanese Patent Application No. 2009-503680 dated May 8, 2012 with English translation, 7 pp.

* cited by examiner

APPARATUS AND METHOD FOR FEEDING A PACKAGING MACHINE WITH A PRODUCT

CROSS-REFERENCE TO RELATED APPLICATIONS

This application is the U.S. national phase of International Application No. PCT/IB2007/000887, filed 4 Apr. 2007, which designated the U.S. and claims priority to Italy Application No. B02006A000246, filed 5 Apr. 2006, the entire contents of each application is hereby incorporated by reference.

DESCRIPTION

The present invention relates to an apparatus and a method for feeding a packaging machine with a product.

In particular, the invention relates to an apparatus and a method for transferring a product contained in suitable containers, for example a pharmaceutical powder, to a dosing unit of said machine and for assembling and/or dismantling automatically and/or semi automatically elements, parts and components of said dosing unit.

In known packaging machines, the dosing unit, which during the machine operation doses preset quantities of a powder product, comprises a tank or hopper, which has to be periodically filled. The hopper is fed by pouring into the latter the contents of a refilling container, typically a barrel or a bag.

The aforesaid container can be directly connected to the hopper or indirectly connected by interposing one or more connecting pipes or conduits.

The operations for transferring, positioning and connecting the refilling container to the hopper are carried out manually by one or more operators, in some cases with the help of a suitable lifting device that is capable to lift the container up to the dosing unit.

These operations are long and laborious and further require the machine to be stopped and therefore production to be interrupted. In addition, it is required a plurality of skilled operators which able to perform the required manual operations.

Likewise, the operations required for assembling the connecting pipe or pipes to the dosing unit are manual. As the pipes are in contact with the product they must be assembled, properly cleaned and sterilised at the start of each new production batch.

In the pharmaceutical field, product packaging processes, and in particular dosing processes, are required to be performed with sterile materials and in sterile environments in order to prevent said products undergoing particle and microbiological contamination, i.e. contamination due to the presence in the air of solid suspended particles such as ash, dust, spores, microorganisms.

For this reason, the packaging machines are placed inside chambers that bound an internal sterile processing environment that is insulated from an adjacent external environment that is not sterile or has a different degree of sterility.

The sterility of the processing environment is ensured by the cleanliness and sterility of each component and element contained inside the sterile chamber and by the presence of a suitable monodirectional flow of sterile air filtered by suitable high-efficiency filters (HEPA). The monodirectional air flow consists of parallel streams of sterile air that move in the same direction substantially at the same speed, in such a way as to create a homogenous air current without turbulence. The air flow when descends from top to bottom forms a front of sterile air that drags away contaminating particles eventually present in the chamber and prevents said particles from rising again from the bottom of the chamber.

Inside the sterile chamber there is provided the entrance for the operators assigned to perform a plurality of operations on the packaging machine, including those disclosed above.

The objective is to perform operations on the machine without compromising the sterility of the sterile environment and without contaminating previously sterilised parts and components assembled or to be assembled on the machine, in order to avoid procedures for restoring sterility that are laborious, long and very expensive. In order to avoid the contamination of the sterile environment, and above all of the parts with which they come into contact, the operators wear suitable protective overalls that cover all parts of their body.

Nevertheless, although they are provided with protective overalls, the operators always constitute a potential source of particle contamination. It has in fact been observed that the proximity and the direct contact of said operators with sterilised objects may compromise the sterility of the latter. It is therefore opportune to avoid direct contact of the operators with parts of the machine that have to contact the product to be packaged, specifically with the connecting pipes of the product and the refilling containers thereof.

In order to overcome this drawback, the packaging machines can be provided with protection cabins that define an internal space that is inaccessible directly by the operators. On the walls of the cabins there are special openings provided with gloves, so-called "glove ports" by means of which the operators are able to handle the objects inside said internal space without coming into direct contact therewith.

Nevertheless, in known packaging machines the operation that are necessary for assembling and/or dismantling parts and components of the dosing unit and for feeding the latter with the product cannot, however, be performed by the operators from outside the cabin, through the glove openings.

It is in fact necessary to open one or more doors of the cabin not only for introducing or extracting parts, components and product containers, but also and particularly for performing the manual assembling/dismantling operations.

In an insertion and mounting step, a direct intervention of the operators inside the machine protection cabin may jeopardize the sterility of the latter and require successive procedures for washing and sterilising the machine and the space inside the cabin, with a consequent increase of cost and time required to set up the machine for production.

In a dismantling and extraction step, typically at the end of production, a direct manual intervention of the operators exposes the latter to the proximity of and contact with parts on which the packaged product is present in more or less great quantities. This direct, prolonged and repeated contact with pharmaceuticals may be harmful and hazardous for the health of the operators, in particular in the case of products in the form of fine powders, which can be easily diffused in the air and thus be inhaled and/or absorbed by the operators.

In order to overcome this problem it is necessary to limit the operating time of each operator, i.e. the time during which the latter is in contact with parts and components touched by the product. This is achieved through a frequent turnover of operators, which requires a suitable number of operators to be available and prepared for operations on the packaging machine, with a consequent increase in the running costs of the plant.

Alternatively, it is necessary to provide the operators with particular equipment, such as completely airtight overalls and masks that are able to insulate the operators completely from the surrounding environment. This equipment is very costly and in addition limits the operator movements and the performable manual operations.

An object of the present invention is to improve known apparatuses and methods for feeding an automatic machine with product to be packaged, in particular a packaging machine operating in a sterile environment.

Another object is to devise an apparatus and a method that enable a dosing unit of an automatic packaging machine to be fed with product without requiring direct manual operations of operators.

A further object is to obtain an apparatus and a method that enable said packaging machine to be fed without requesting the stop thereof, i.e. without interrupting the production.

Another object is to obtain an apparatus and a method that allows transferring and assembling and/or dismantling components for conveying the product to the dosing unit, without requiring direct manual operations by operators.

Still another object is to carry out an apparatus and a method allowing the operators to avoid direct contact with product containers and with parts and components to be transferred and assembled and/or dismantled.

In a first aspect of the invention an apparatus is provided for feeding with a product to be packaged a packaging machine having a dosing unit, comprising a lifting arrangement for picking and moving at least a container of said product in such a way as to connect said container to said dosing unit to transfer to the latter the product contained in said container.

Owing to this aspect of the invention it is possible to carry out an apparatus that enables a dosing unit of a packaging machine to be fed with product without requiring the direct manual operation of operators. The lifting arrangement in fact allows the container to be removed and connected to the dosing unit in a substantially automatic manner.

The lifting arrangement and the structure of the machine further allow transferring and assembling and/or dismantling parts and components for conveying the product from the container to the dosing unit, in an automatic manner or with reduced interventions by operators.

Such conveying arrangement, interposed between the product container and the dosing unit, facilitates the connection and forms an intermediate product store tank, that enables the packaging machine to operate even during operations that are necessary for replacing an empty product container with a full product container. In this way the apparatus of the invention enables the packaging machine to be fed continuously without interrupting production.

As the apparatus is provided with a containing element arranged for enclosing the lifting arrangement and defining an operating space that is substantially insulated and airtight, it is possible to avoid direct contact of the operators with product containers and with conveying arrangement. The operators can, in fact, operate inside the apparatus only indirectly through openings for gloves provided on side walls of the containing element. This insulation is particularly advantageous because it avoids direct contact of the operators with the product to be packaged and/or with sterile parts and components to be assembled.

In a second aspect of the invention a method is provided for feeding with a product to be packaged a packaging machine having a dosing unit with the apparatus according to the first aspect, comprising inserting a container of said product inside said apparatus, fixing said container to a lifting arrangement of said apparatus, moving said container using said lifting arrangement in such a way as to connect it to said dosing unit, transferring the product contained in said container to said dosing unit.

The invention can be better understood and implemented with reference to the enclosed drawings that illustrate a preferred embodiment by way of non-limiting example, in which.

Figure 1:
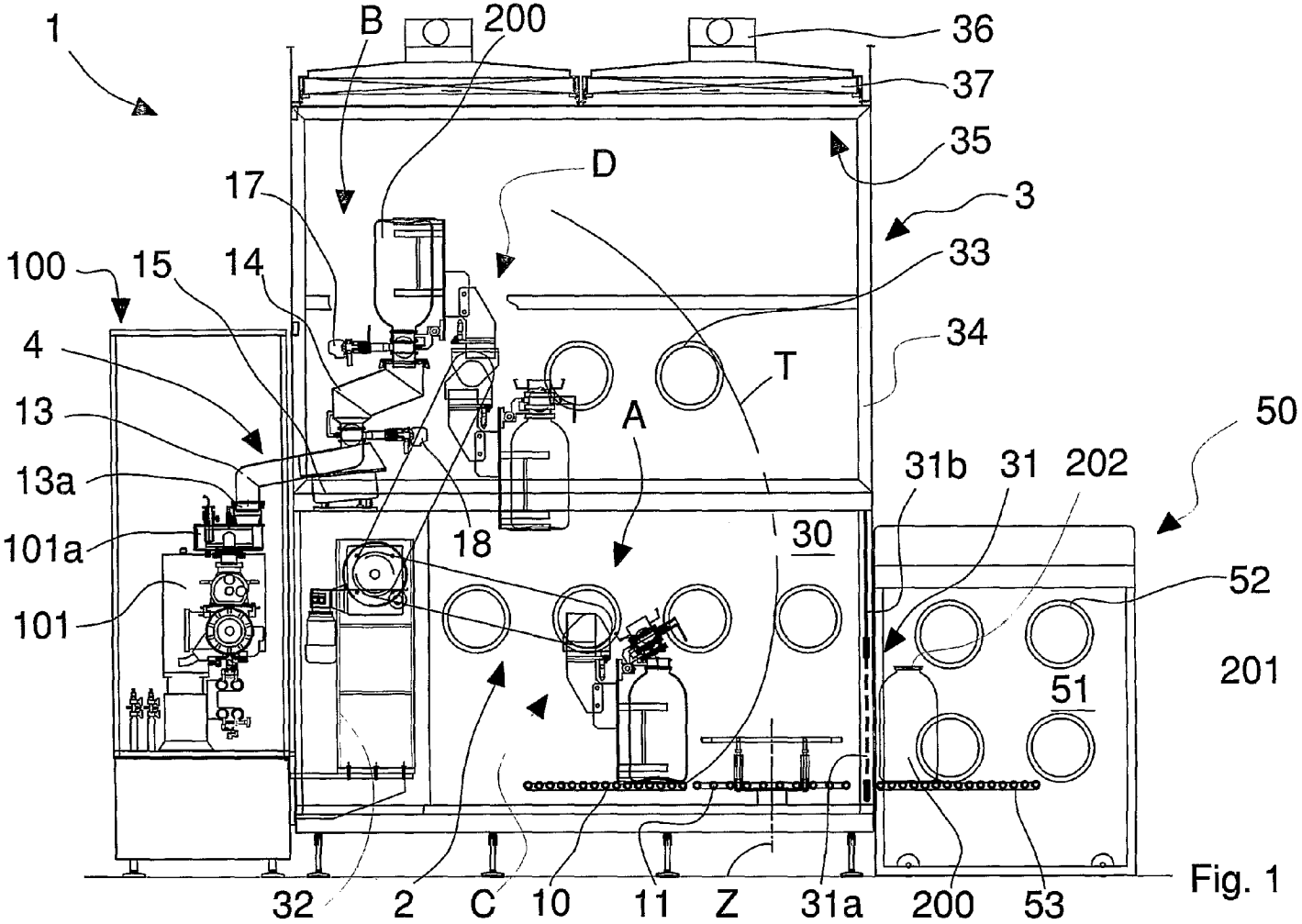
FIG. 1 is a schematic front view of an apparatus according to the invention in association with a packaging machine and a transferring unit, in which a lifting arrangement is shown that supports a first product container, represented in various and successive operating positions.
Figure 2:
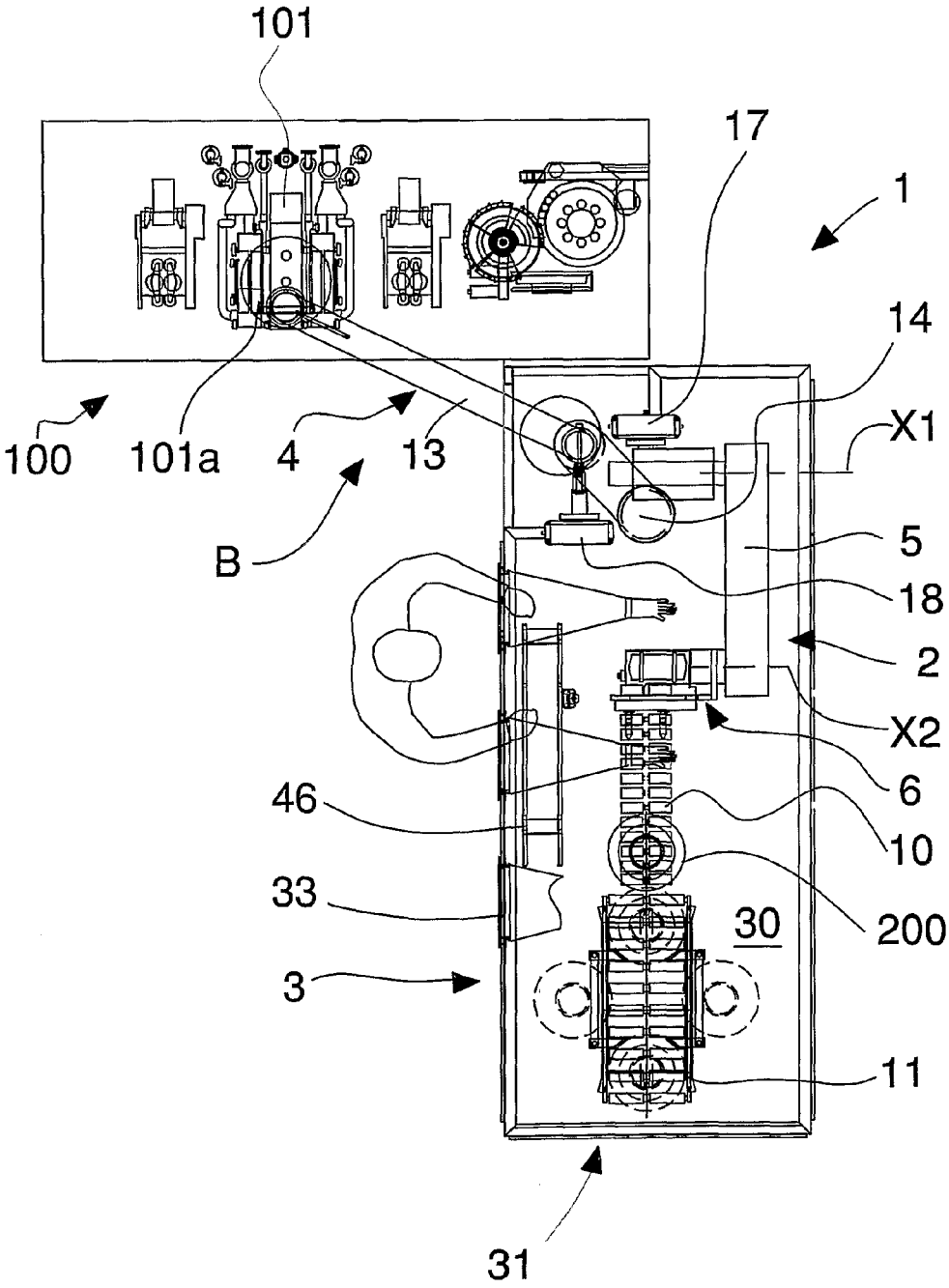
FIG. 2 is a top view of the apparatus in FIG. 1.
Figure 3:
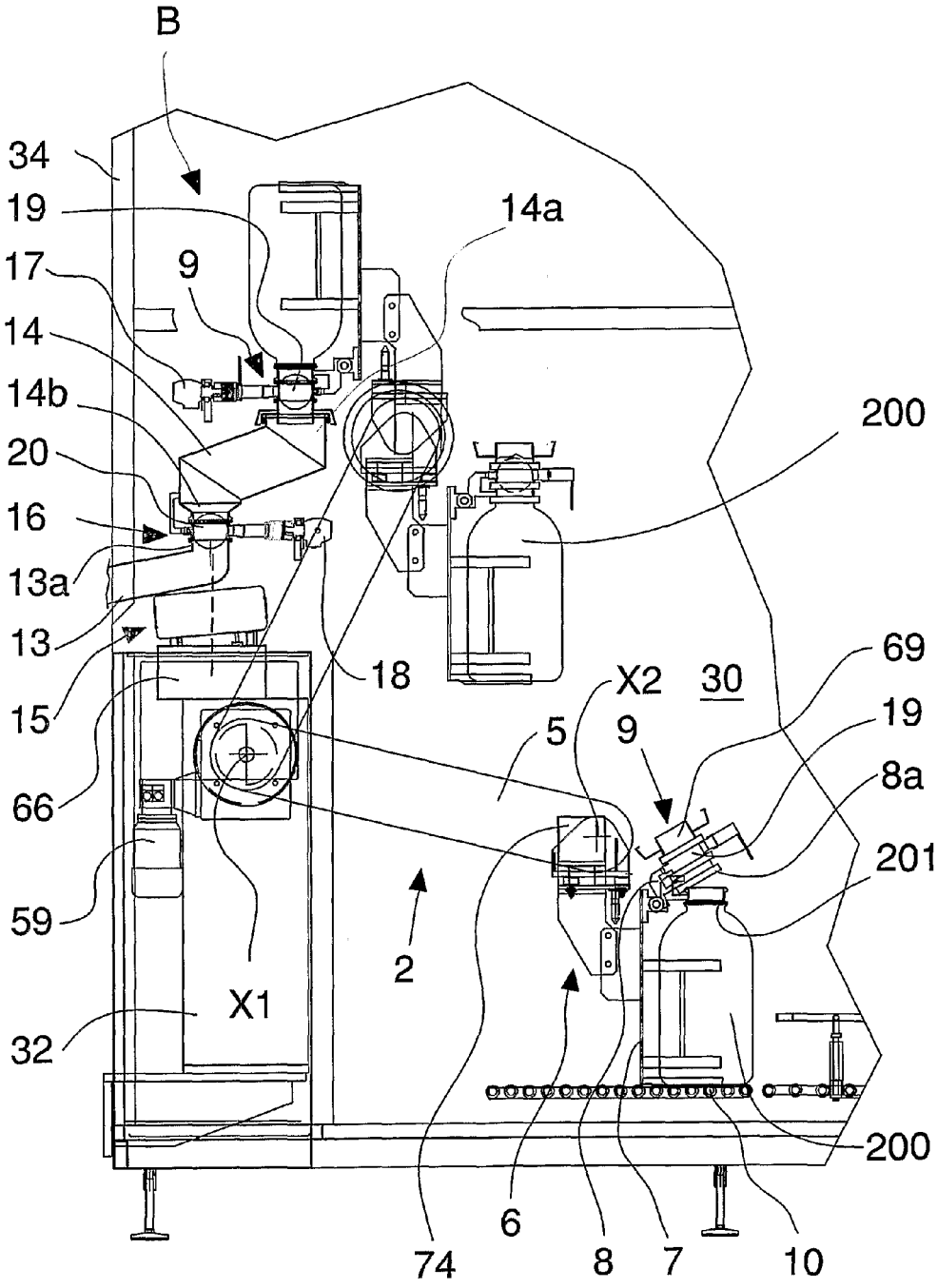
FIG. 3 is an enlarged partial view of the apparatus in FIG. 1.

With reference to FIGS. 1 to 3, numeral 1 indicates an apparatus for feeding a product to be packaged, for example a product in powder, to a packaging machine 100 provided with a dosing unit 101.

The apparatus 1 comprises a lifting arrangement 2 for taking a product container 200 in a picking position A, and moving said container 200 to a feeding position B in which an opening 201 of said container 200 is connected to the dosing unit 101 so as to enable the product to drop by force of gravity. In this case, the container 200 is a rigid drum or barrel with a cylindrical shape.

A conveying arrangement 4 is provided for connecting said opening 201 of the barrel 200 to a hopper or feeding tank 101*a* of the dosing unit 101.

The apparatus 1 further comprises a containing element 3 configured for enclosing the lifting arrangement 2 so as to define an operating space 30 that is practically isolated from the environment in which the apparatus 1 is positioned and separated from the packaging machine 100. The latter, for example, can be arranged adjacent to the apparatus 1.

The containing element 3 consists substantially of a cabin provided with side walls on which there is fixed a plurality of openings for gloves 33, so-called "glove ports", which enable the operators to access and indirectly operate inside the operating space 30.

The cabin 3 has an access 31 that enables a product container 200 to be introduced inside and removed therefrom. The access comprises an opening 31*a* that can be hermetically closed by means of a door 31*b*.

The apparatus 1 is provided with a ventilation device 35 arranged in an upper portion of the cabin 3 for generating a vertical mondirectional air flow from top to bottom. The ventilation device 35 comprises one or more fans or blowers 36 that are able to suck sterile air from the external environment and direct it, through a filter arrangement 37, for example high-efficiency filters, to inside the operating space 30.

The lifting arrangement 2 comprises an anthropomorphic arm equipped with an elongated member or arm 5 hinged on an end thereof and rotatably supporting, at the remaining free end, a connecting member or wrist 6.

The arm 5 is rotatably connected to a supporting frame 32 of the apparatus 1 in such a way as to rotate around a first rotation axis X1, which is horizontal, i.e. substantially parallel to a sustaining plane 90 of the apparatus 1, between a lower position C and an upper position D.

The supporting frame 32 can be fixed to the structure of the packaging machine 100 to minimise the positioning errors of the conveying arrangement 4.

The wrist 6 is rotatably coupled with the arm 5 around a second rotation axis X2, which is substantially parallel to the first rotation axis X1.

A driving arrangement 59 is provided for moving in an independent manner the arm 5 and the wrist 6. Said driving device 59 may comprise, for example, a pair of brushless electric motors, controlled by a management and control unit in such a way as to move the arm 5 and the wrist 6 according to complex motion trajectories, with set speed and acceleration values.

A transmission arrangement that is of known type and not shown, is provided inside the arm 5 to connect the wrist 6 to the respective motor of driving device 59. A first supporting arrangement 7 suitable for receiving and supporting the barrel 200 is fixed to the wrist 6.

A joint 8 is rotatably connected to the first supporting arrangement 7. The joint 8 comprises an attachment portion 8*a* arranged for connecting the opening 201 of the barrel 200 to a first fitting arrangement 9 configured for engaging and connecting to the conveying arrangement 4 in the feeding position B.

The removable connection of the joint 8 to the opening 201 and to the fitting arrangement 9 is achieved, for example, through Tri-clamp connections or the like. The connection to the joint 8 enables the barrel 200 to be fixed firmly to first supporting arrangement 7.

The first fitting arrangement 9 comprises a first valve 19, consisting for example of a known type of rotating cell that is arranged for closing the opening of the barrel 201 in order to enable the movement thereof with no loss of powder. First valve 19, in the feeding position B is controlled in opening to enable the powder product to come out from the barrel.

The apparatus 1 further comprises a sustaining arrangement 10, 11 suitable for slidably supporting the barrel 200. In particular, the sustaining arrangement comprises a first sustaining plane 10 and a second sustaining plane 11 that are substantially coplanar and enable the barrel 200 to be moved inside the operating space 30 between the loading zone P and the first door 31*b* of the cabin 3, through which first door the barrel 200 is inserted and/or removed.

Second sustaining plane 11 that is interposed between the first sustaining plane 10 and the first door 31*b* is mounted rotatably around an axis Z that is substantially orthogonal to the plane 11. Second sustaining plane 11 by rotating allows a full barrel to be introduced into the apparatus 1 and at the same time allows a empty barrel to be removed, as explained in detail in the following.

An embodiment of the apparatus 1 that is not illustrated comprises a further access that is arranged on a front wall of the cabin 3 to remove the empty barrel. In this way, it is possible to separate the loading zone of product containers from the unloading zone of the empty containers.

The sustaining planes 10, 11 comprise, for example, respective idling or driven roller conveyors.

In a condition of use, the conveying arrangement 4 is removably fixed to a vibrating supporting device 15 that is able to transmit vibrations to the conveying arrangement 4 during operation such as to make easier the sliding and the descent of the powder product.

For this reason, the gripping arrangement 6 comprises respective vibrating device 74 for transmitting to the container 200 vibrations such as to break up and make slidable the powder product contained therein.

Figure 12:
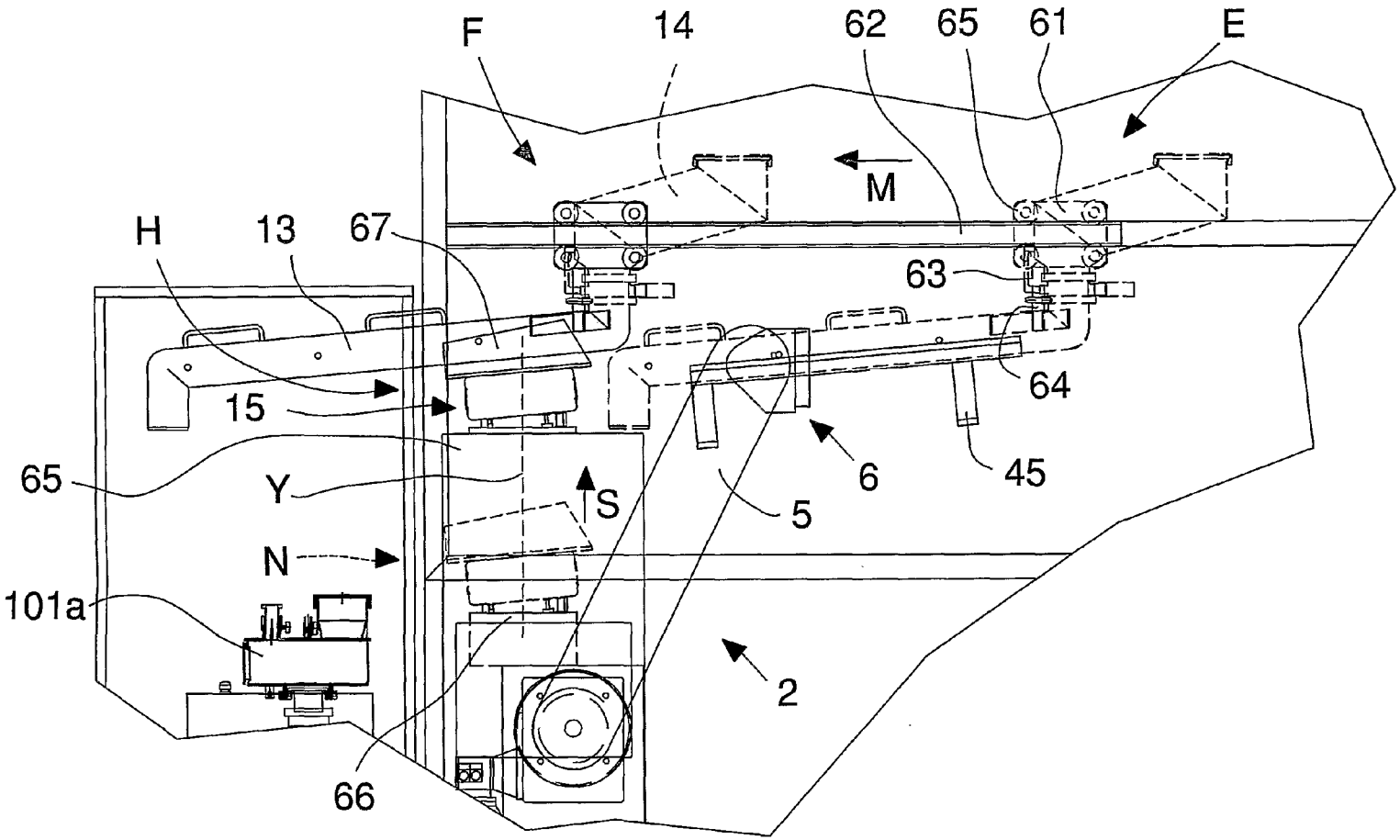
FIG. 12 is an enlarged partial view of the apparatus in FIG. 9, showing a conveying arrangement in two distinct upper operating positions.

The apparatus 1 comprises a first moving arrangement 66 suitable for moving and rotating the vibrating supporting device 15. In particular, the first moving arrangement 66 is arranged for lifting and/or lowering the vibrating supporting device 15 along a vertical lifting direction S, i.e. substantially orthogonal to the sustaining plane 90, and at the same time for rotating the vibrating supporting device 15 by a preset angle, comprised for example between 20° and 90°, around an axis Y which is substantially parallel to said lifting direction S (FIG. 12).

The first moving arrangement 66 comprises, for example, a linear actuator and a cam of known type and which have not been shown that rotate the vibrating supporting device 15 during rectilinear movement thereof.

The conveying arrangement 4 comprises a feeding pipe 13 having an elongated shape and a storing pipe 14 which are connected together through a connecting arrangement 16. The latter comprises an adjusting device 20, consisting for example of a rotating cell of known type, arranged for hermetically sealing an internal conduit of said connecting arrangement 16 and therefore the passage between the storing pipe 14 and the feeding pipe 13.

The feeding pipe 13 and the storing pipe 14 comprise respective end portions having almost parallel axes and which in use are almost vertical and orthogonal to the sustaining planes 10, 11. The end portions of each pipe are connected together by respective elongated central portions having axes that are incident and tilted with respect to the axes of the corresponding end portions.

A first end portion 13*a* of the feeding pipe 13 is inserted into the hopper 101*a* of the dosing unit 101, whilst a respective first end portion 14*a* of the storing pipe 14 is connected to the barrel 200 in the feeding position B, by means of a respective connecting portion 69 of the first fitting arrangement 9.

Remaining second end portion 13*b* of feeding pipe 13 and remaining second end 14*b* of storing pipe 14 are connected together through the connecting arrangement 16.

A conveying arrangement 4 enables the barrel 200 and the hopper 101*a* to be connected and acts as a product store tank to enable the packaging machine 100 to operate even during the operations that are necessary for replacing an empty product container with a full product container.

In particular, the dimensions of the storing pipe 14 are such as to contain a part of the contents of the barrel 200, in such a way that said pipe 14 could act as an intermediate feeding hopper for the dosing unit 101. The adjusting device 20 allows adjusting the product sliding from the storing pipe 14.

The apparatus comprises a first actuating device 17 and a second actuating device 18 configured for engaging and driving respectively the first valve 19 and the adjusting device 20 in the feeding position B. In particular, the actuating devices 17, 18 can be connected to respective control stems that control a rotation of the rotating cells 19, 20.

Actuating devices 17, 18 are, for example, rotating, pneumatic or electric actuators and they are fixed to the supporting frame 32 of the apparatus 1.

The operation of the apparatus 1 provides introducing a barrel 200 of product inside the cabin 3 through the first door 31*b*.

The barrel 200, closed by a cap 202, can be carried by a transferring unit 50 that is brought near to the apparatus 1 in such a way as to put in communication the operating chamber 30 of the cabin 3 with the inner chamber 51 of the transferring unit 50, by opening the access 31.

The transferring unit 50 is provided with a slidable support 53, for example a roller conveyor, arranged facing and almost coplanar with the sustaining arrangement 10, 11 of the apparatus. The barrel 200 can be manually moved from the transferring unit to the second sustaining plane 11 by operators through the opening for gloves of the cabin 3 and possible openings for gloves 52 that can be provided on the transferring unit 50. Alternatively, transferring unit may comprise a movable supporting arrangement of barrel that is able to exit partially from said transferring unit and position said barrel 200 directly on the second sustaining plane 11.

The latter is then rotated around the vertical axis Z thereof to arrange the barrel 200 full of products opposite the first sustaining plane 10 and simultaneously position a possible empty barrel at the door 31*b* for the subsequent removal thereof.

If the sustaining planes 10, 11 comprise idling rollers, an operator transfers the barrel 200 on the first sustaining plane 10 to the loading zone P and moves said container 200 until it abuts on the first supporting arrangement 7 in the picking position A.

First supporting arrangement 7 are fixed previously to the wrist 6 of the lifting arrangement 2, arranged in the lowered position C.

At this point, the barrel 200 can be opened by removing the cap 202 and the opening 201 thereof can be closed through the connection to first joint 8, to which first fitting arrangement 9 is fixed.

The joint 8, which is hinged on the first supporting arrangement 7, is simply rotated until it engages the opening 201 of the barrel 200.

After the connection has been made, the barrel 200 is fixed to the first supporting arrangement 7 and is suitably closed by the first joint 8 in association with the first fitting arrangement 9.

At this point the lifting arrangement 2 is driven to lift and move the barrel 200 in such a way as to make the first fitting arrangement 9 connect up with the free end portion 14*a* of the storing pipe 14. In order to obtain this result, the barrel is subjected to a rotation and rectilinear motion obtained through the simultaneous or sequential rotation of the arm 5 around the first rotation axis X1 and of the gripping arrangement 6 around the second rotation axis X2. The arm rotates, for example, by an angle comprised between 50° and 80° from the lowered position C to the upper position D, whilst the gripping arrangement 6 rotates by 180° in such a way as to overturn the barrel and arrange the opening 201 facing downwards, in the feeding position B. If rotation of the arm 5 of the gripping arrangement is simultaneous the barrel 200 moves following the trajectory T of FIG. 1.

In the feeding position B, the first valve 19 of first fitting arrangement 9 is connected to the first actuating device 17. The operation of the latter causes opening of the first valve 19 and thus the descent of the powder product into the storing pipe 14.

Sensors of known type and not shown in the figures, are provided for controlling the level of product in the conveying arrangement 4.

When the container 200 is empty, the lifting arrangement 2 returns the latter to the first sustaining plane 10 in the picking position A. After being detached from the first fitting arrangement 9, the barrel 200 can be moved to the second sustaining plane 11 and then transferred outside the apparatus, for example loaded onto the transferring unit 50.

With reference to FIGS. 4 to 8, the apparatus 1 is arranged for feeding the packaging machine 100 with powder product fed by second containers 300 in the form of bags or sachets.

The opening 31*a* allows to introduce into the apparatus a bag 300 containing a powder product or to remove an empty bag. The sustaining arrangement of the apparatus comprises a third sustaining plane 21, positioned at the door 31*b* and arranged for receiving and supporting the bag 300 during introducing and/or removing.

The bag 300 is carried, for example, by the transferring unit 50.

The bag 300 is positioned inside a sealed external packaging 310 on a slidable support 53, for example a respective roller conveyor of the transferring unit 50. The external packaging 310 preserves the sterility of bag 300, which has to be introduced into the apparatus 1 without coming into direct contact with the operators.

The bag 300 can be moved from the transferring unit 50 to the third supporting plane 21 manually by one or more operators operating through suitable openings for gloves 33, 52 of the cabin 3 and of the transferring unit 50'.

After the opening of the external packaging 310, the operator keeps the latter immobilised and simultaneously pushes the bag 300 to exit through the opening 31*a* onto the roller conveyor 21, ensuring that he does not touch it.

The opening 31*a* can be provided with devices for stopping and preventing the passage of the external packaging 310.

The third sustaining plane 21 is slightly inclined downwards in the direction of the lifting arrangement 2 to facilitate the transfer of the bag 300 to said lifting arrangement 2.

Instead of the first supporting arrangement 7, a second supporting arrangement 22 is fixed to the wrist 6 of the lifting arrangement 2 for receiving and supporting the bag 300.

The bag consists, for example, of two sheets of superimposed plastic material sealed along peripheral edges in such a way as to form a hermetically sealed flexible and yielding packaging having the shape of a "bottle".

Figure 6:
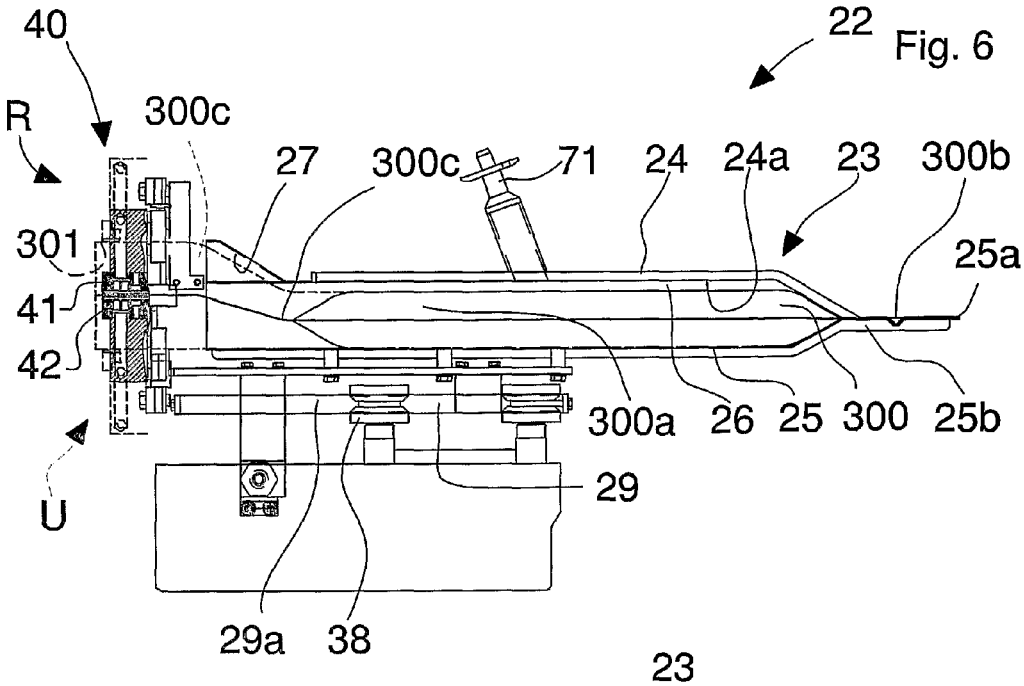
FIG. 6 is an enlarged side view of a supporting arrangement of second product container.
Figure 8:
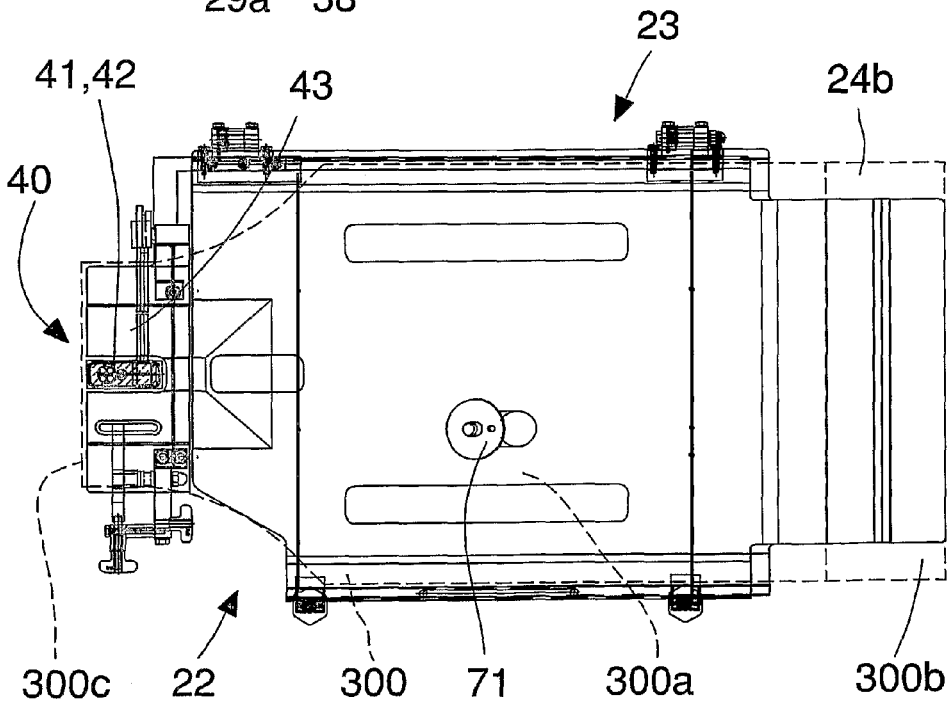
FIG. 8 is a top view of the supporting arrangement in FIG. 6.
Figure 7:
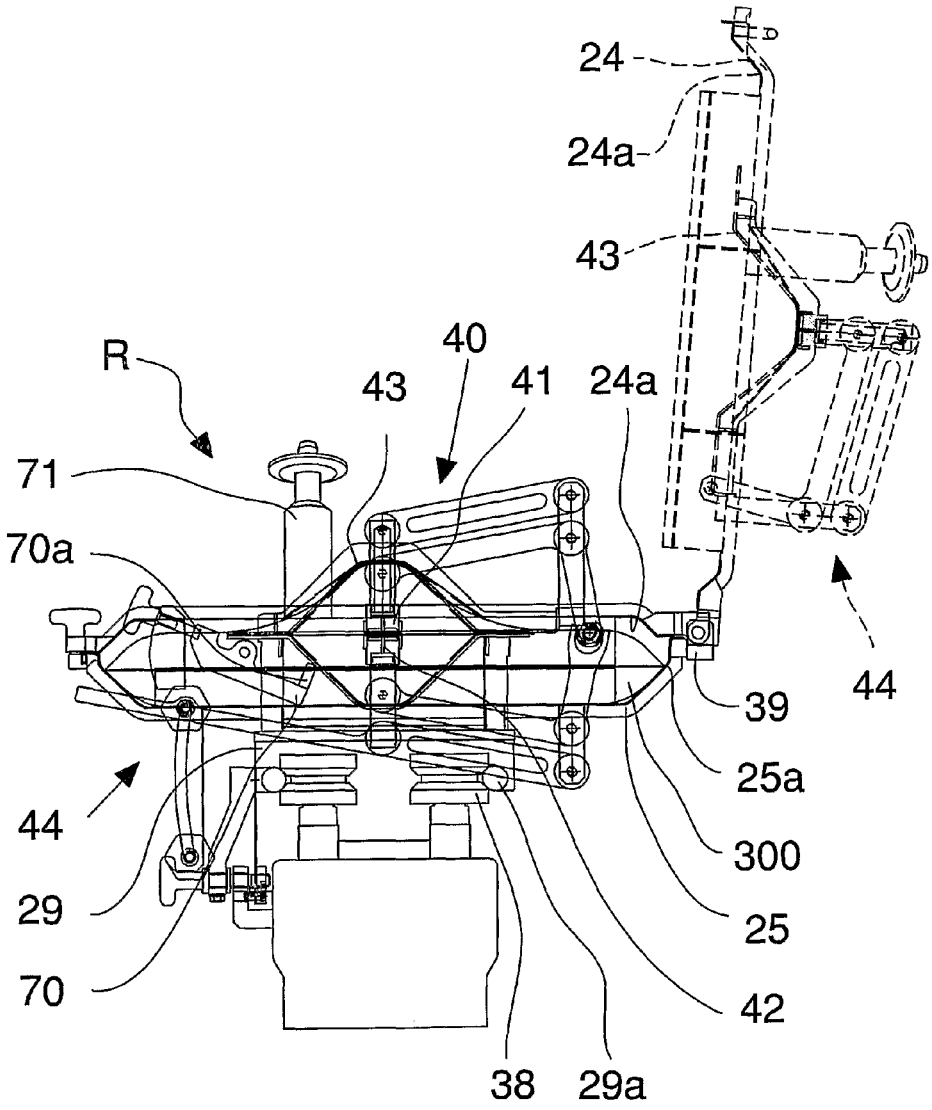
FIG. 7 is a front view of a supporting arrangement of FIG. 5, showing a wrapping arrangement in a closed position and, shown by a broken line, in an open position.

With particular reference to FIG. 8, the bag 300 has a central portion 300*a* inside which the product collects, a bottom portion 300*b* and a neck portion 300*c* with an elongated rectangular shape that has to be cut transversely for opening the bag. With particular reference to FIG. 6 to 8, second supporting arrangement 22 comprises a fixed supporting element 28 to which an enclosure arrangement 23 for receiving the bag 300 is slidably fixed.

In particular, the enclosure arrangement 23 comprises two parts, an upper part 24 and a lower part 25, that are superimposable and substantially specular and are provided with respective cavities 24*a*, 25*a* that are suitable for forming, in a closed condition of said enclosure arrangement 23, an internal housing 26 that is able to contain and enclose the central portion 300*a* of the bag 300.

The cavities 24*a*, 25*a* are configured to form also a passage 27 through which the neck portion 300*c* of the bag can exit.

End portions 24*b*, 25*b* of the upper part 24 and lower part 25 can compress the bottom portion 300*b* of the bag 300 to lock the latter inside enclosure arrangement 23.

The two parts 24, 25 are hinged together along a longitudinal edge by means of hinges 39 that enable the enclosure arrangement 23 to be opened and closed "as a book" to allow the bag 300 to be introduced easily.

The enclosure arrangement 23 comprises a first carriage 29 supporting the lower part 25 of the enclosure arrangement 23 and provided with rectilinear guides 29*a*, slidably supported by idling rollers 38 of the supporting element 28. The first carriage 29 is movable in a sliding direction V, which is substantially longitudinal and parallel to the sustaining plane 90.

Once the bag 300 has been inserted into the enclosure arrangement 23, the neck portion 300*c* of the bag 300 is extended for executing a transverse opening cut thereupon.

An opening arrangement 40 is provided to enable the two plastic sheets to be detached that constitute the bag 300, at the neck portion 300*c* on which the cut was performed that is necessary to make the bag opening 301.

Second fitting arrangement 46 is provided to connect the bag 300 to the conveying arrangement 4.

The opening arrangement 40 further comprises an abutment guide 73, for example a shaped metal sheet suitable for guiding a knife handled by an operator during cutting of the neck portion 300*c* and for protecting from accidental contact with the gloves of the operator an inlet portion 47 of the second fitting arrangement 46, which inlet portion 47 is arranged for being inserted into the opening 301 of the bag 300 created by the opening arrangement 40.

The protective metal sheet 73 is removed by the operator before connecting the third protection element 45 to the bag 300.

In an embodiment that is not illustrated, the opening arrangement 40 comprises a cutting element that is slidably fixed to the abutment guide 73 to cut the neck portion 300*c* of the bag.

The pening arrangement 40 comprises a first suction cup 41 and a second suction cup 42 connected to a vacuum source so as to be able to adhere by vacuum to the external surfaces of the bag 300, on both sides.

The first suction cup 41 and the second suction cup 42 face each other and are movable in opposite directions, between an adhesion position R, in which they almost abut to adhere to respective flaps of the bag 300 that are joined together and a detachment position U in which said suction cups 41, 42 are spaced in such a way as to separate and move apart the two flaps to form the product outlet opening 301.

The opening arrangement 40 further comprises an abutting element 43 arranged around the neck portion 300*c* and arranged for being abutted by the flaps of the bag 300 that are widened and separated by the suction cups 41, 42. The abutting element 43 give the shape or section of the opening 301 of the bag 300.

A third actuating device 44 is provided for driving the suction cups 41, 42. This actuating device 44 comprises a plurality of levers that is able to move and/or lock the suction cups 41, 42 in the two adhesion R and detachment U positions.

A second fitting arrangement 46 further comprises a respective connecting portion 48 arranged for engaging the end portion 14*a* of storing pipe 14.

In a condition of use, second fitting arrangement 46 is fixed to the supporting element 28 of the second supporting arrangement 22 and comprises a second valve 49 similar to first valve 19 and arranged for closing the mouth of the bag 300 to enable movement thereof without powder exiting.

The second valve 49 in the respective feeding position B' of the bag 300 is operated to open in order to allow the powder product to exit from the bag.

The inlet portion 47 of second fitting arrangement 46 is inserted into the bag 300 by moving the bag towards said inlet portion 47, i.e. by moving the enclosure arrangement 23, the latter being slidable, due to the first carriage 29, along the movement direction V.

The first carriage 29 can be moved manually by an operator, using one or more gloves of respective openings for gloves 33, or by driving device mounted on said first carriage 29.

After insertion, a locking arrangement 70 seal the neck portion 300*c* of the bag to the inlet portion 47 in order to prevent product escaping.

the locking arrangement 70 comprises, for example, a lever fixed rotatably to the lower part 25 of enclosure arrangement 23 and provided with a tooth 70*a* that is suitable for being inserted into a slot 47*a* made in the inlet portion 47 of second fitting arrangement 46.

In a locking condition of lever 70, the tooth 70*a* by being inserted into the slot 47*a* pushes into the latter a part of the neck portion 300*c* of the bag, holding and locking said bag around the inlet portion 47. The lever 70 can be locked in the locking position by means of a screw and a threaded knob.

The simultaneous or sequential rotation of arm 5 and wrist 6 enables the bag 300 to be lifted and moved in such a way as to make the second fitting arrangement 46 abut on the storing pipe 14.

In order to obtain this result, the arm is rotated from the lowered position C to the raised position D, for example by an angle comprised between 70° and 130°, whilst the wrist 6 is rotated by 45° in such a way as to upturn the bag 300 and arrange the respective connecting portion 48 of second fitting arrangement 46 vertical and aligned with the end portion 14*a* of storing pipe 14, in the respective feeding position B' of the bag 300.

Figure 4:
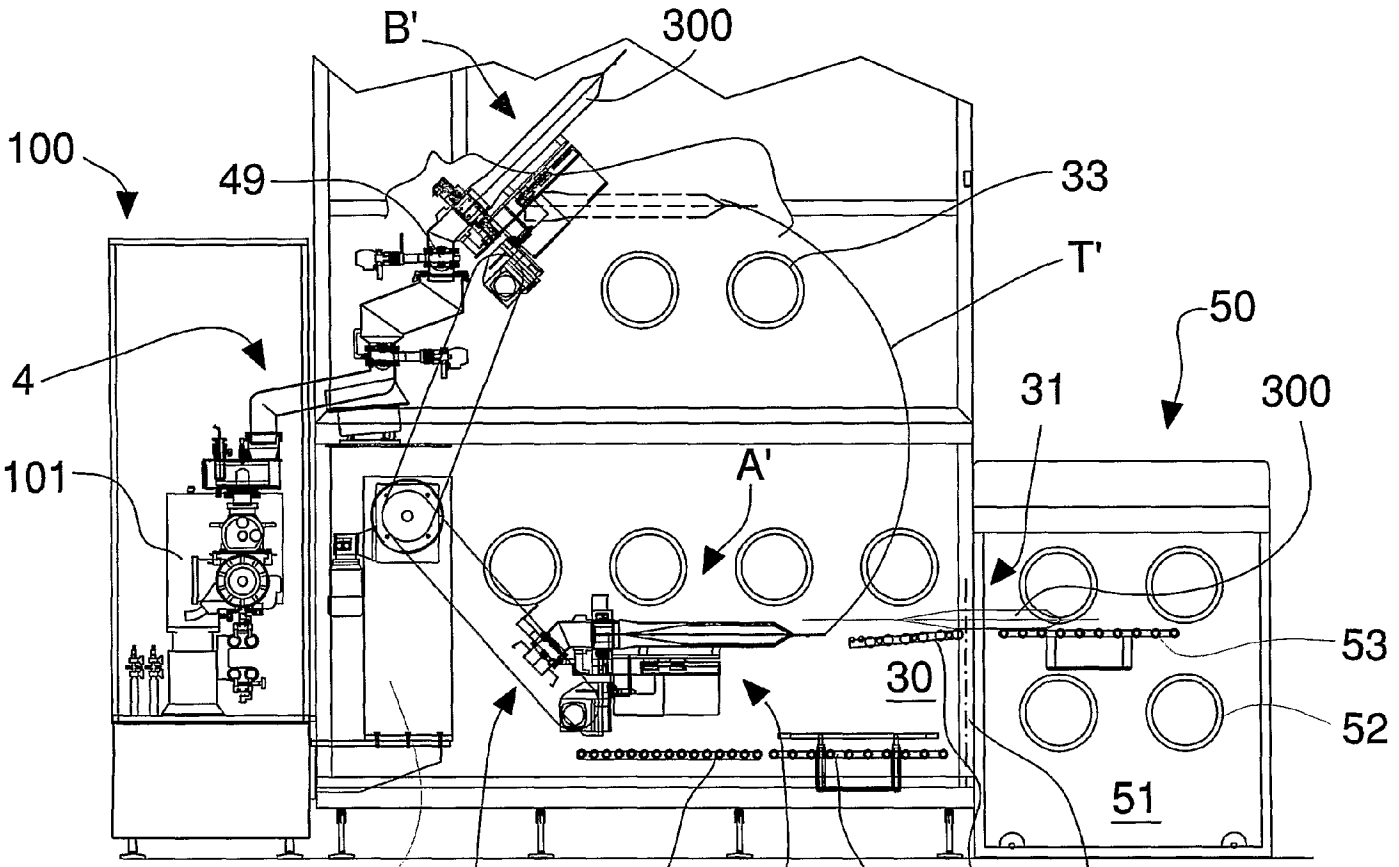
FIG. 4 is a view like the one in FIG. 1 showing a lifting arrangement supporting a second product container, represented in various and successive operating positions.
Figure 5:
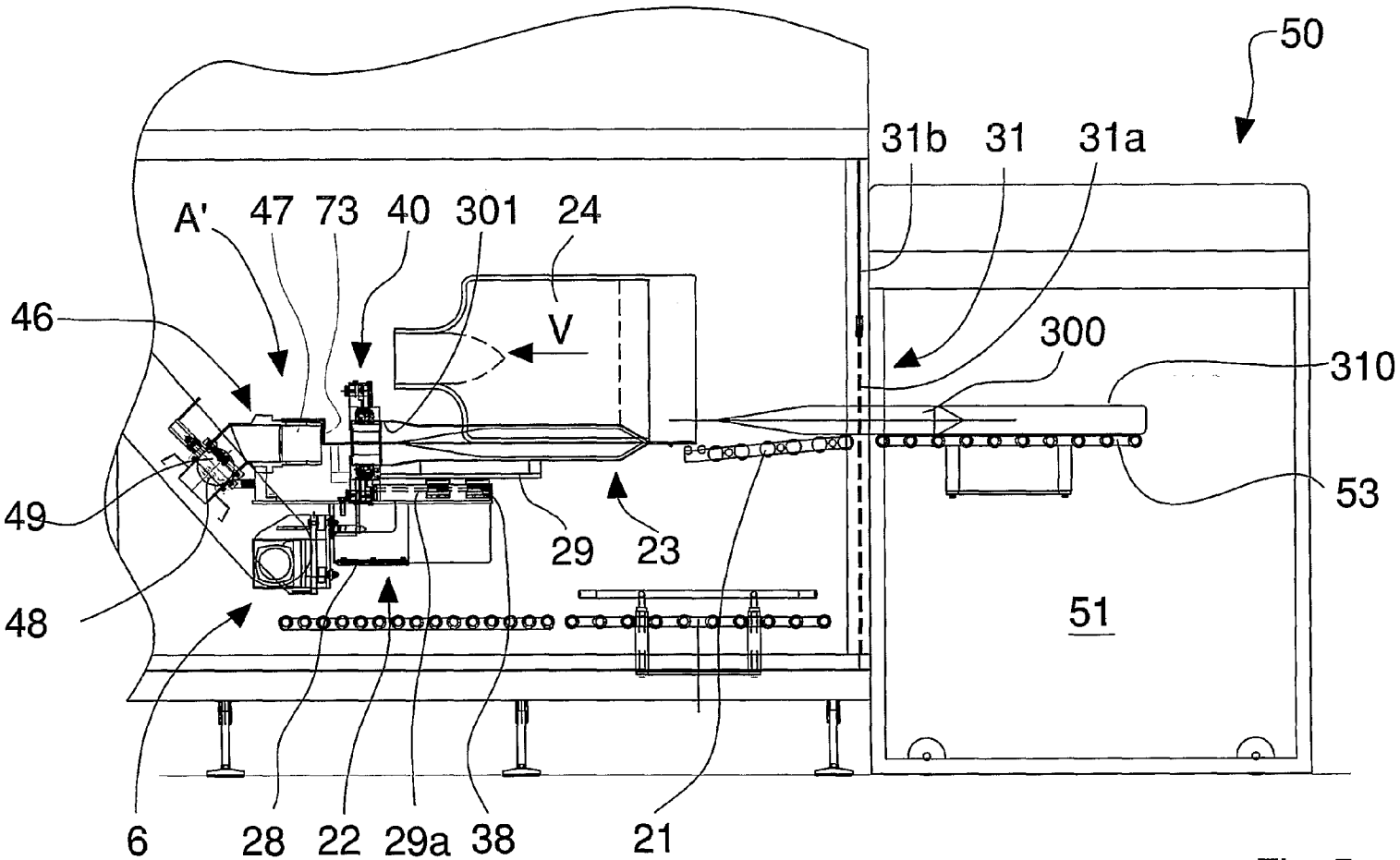
FIG. 5 is an enlarged partial view of the apparatus in FIG. 4, showing the second container in various phases of introduction into the apparatus.

If rotation of arm 5 and wrist 6 is simultaneous, the bag 300 moves following the trajectory T' in FIG. 4.

In the respective feeding position B', the second valve 49 of second fitting arrangement 46 is connected to the first actuating device 17. The operation of the latter determines opening of second valve 49 and descent of powder product into the storing pipe 14.

After emptying has been completed, the lifting arrangement 2 returns the bag 300 to the respective picking position A'. After being released by second fitting arrangement 46, the empty bag 300 can be extracted from the enclosure arrangement 23, moved to the third sustaining plane 21 and then transferred outside the apparatus 1, for example to the transferring unit 50, or be placed inside a compartment situated inside the cabin 3.

Figure 9:
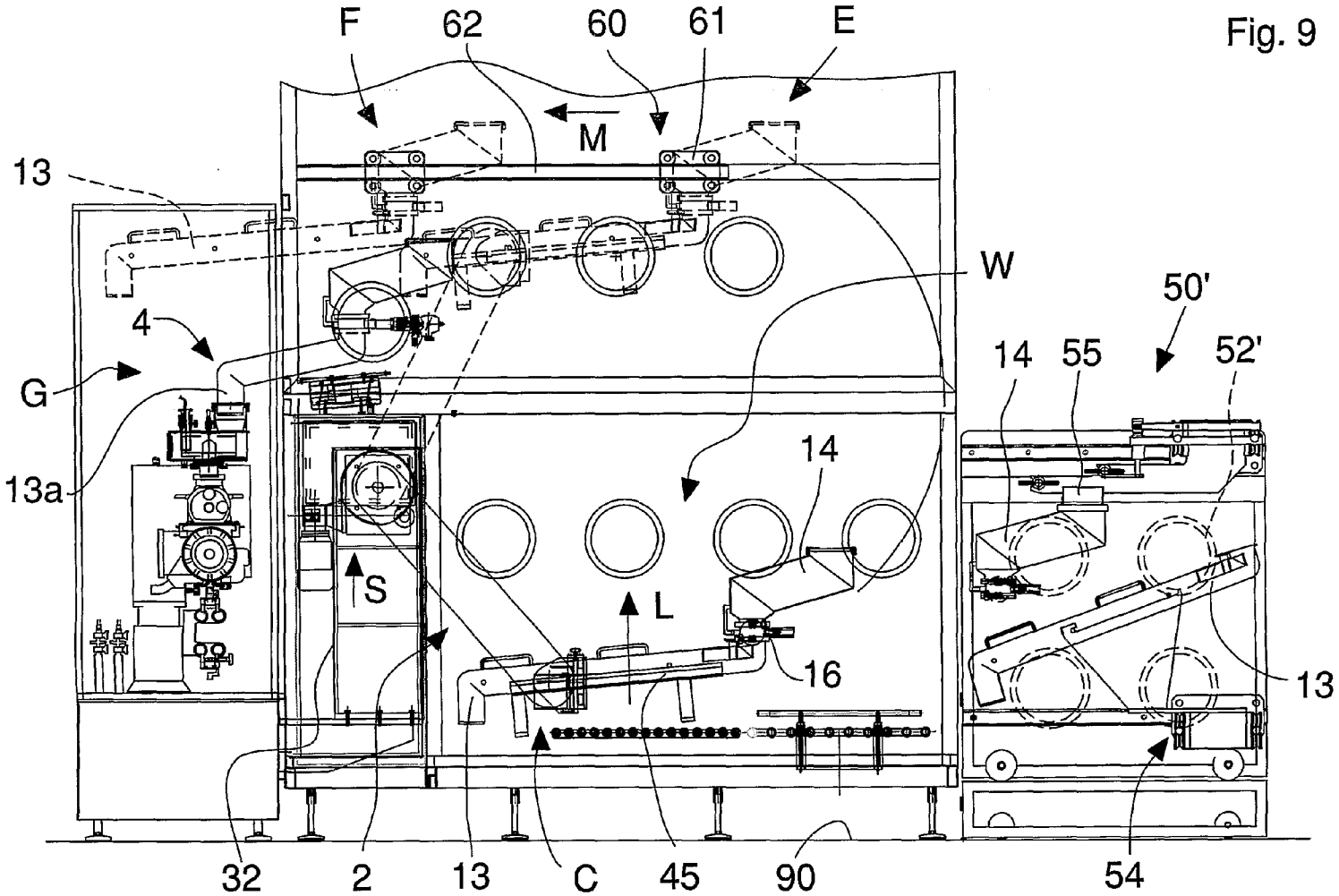
FIG. 9 is a view like the one in FIG. 1, showing a lifting arrangement supporting a conveying arrangement of the product, shown in various and successive operating positions.
Figure 10:
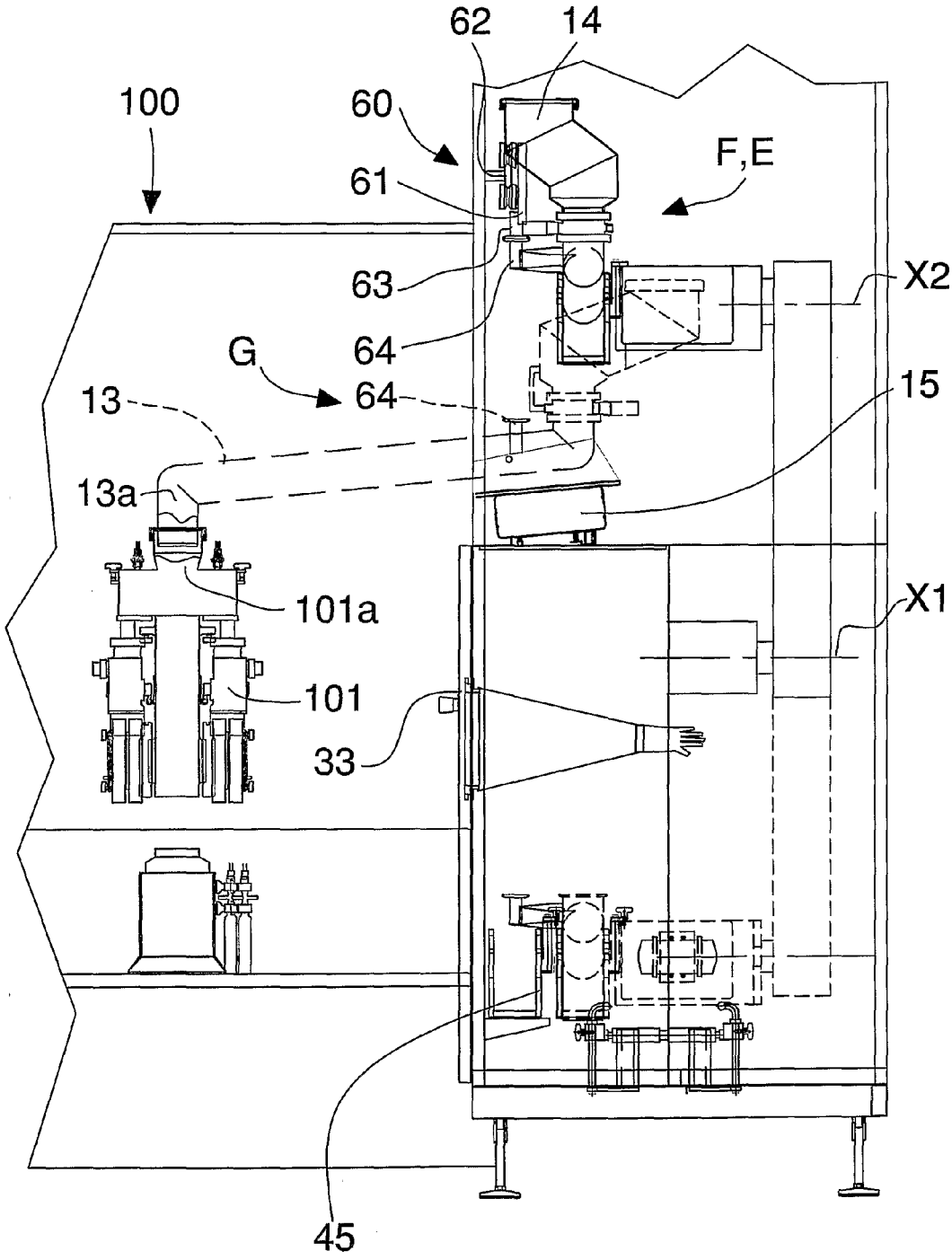
FIG. 10 is a schematic and partial side view of the apparatus in FIG. 9, showing a conveying arrangement in a connecting position and, shown on a broken line, in an upper position.
Figure 11:
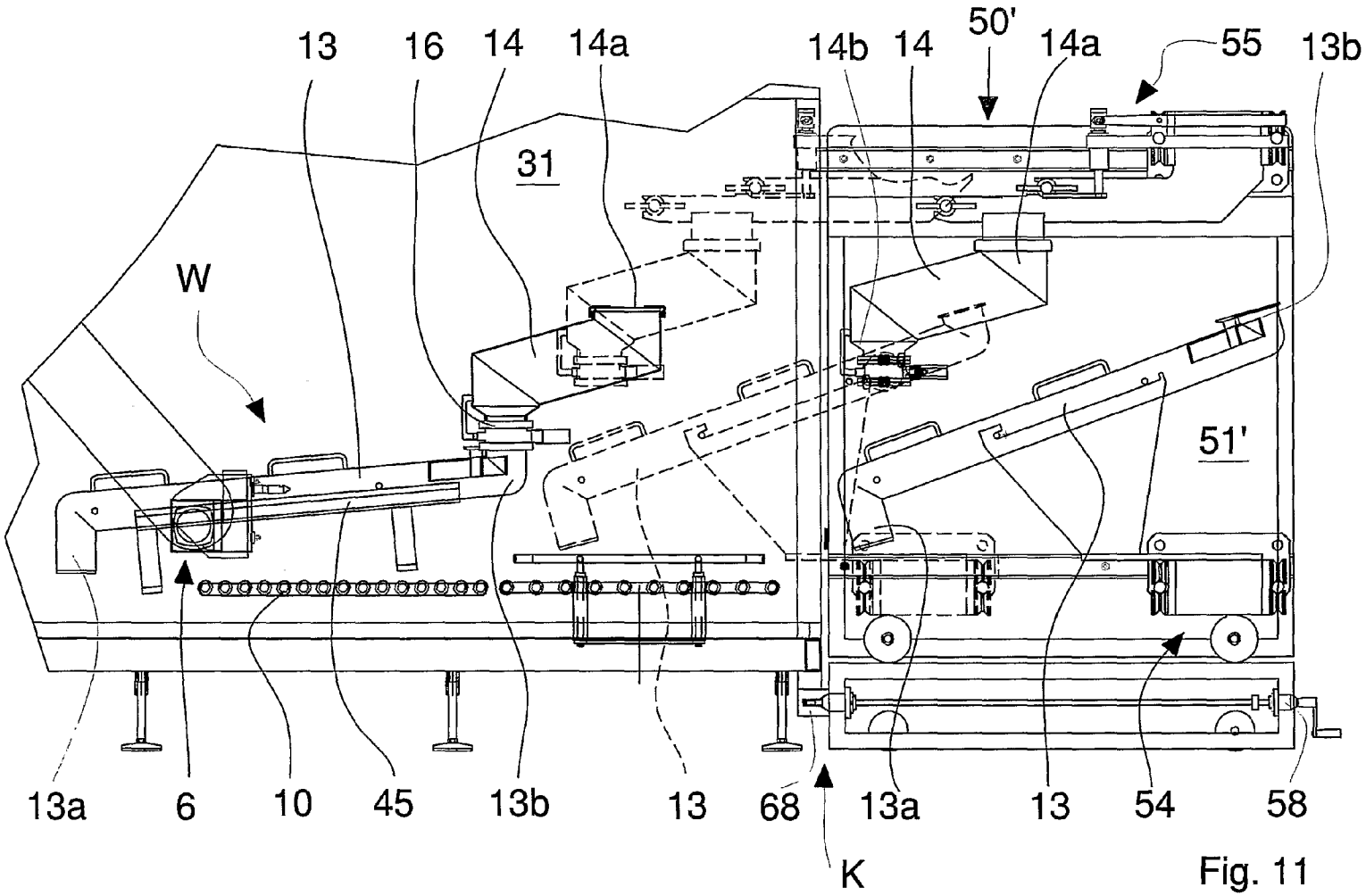
FIG. 11 is an enlarged partial view of the apparatus in FIG. 9, showing a conveying arrangement in various steps of introduction into the apparatus.

With reference to FIGS. 9 to 11, the apparatus 1 is arranged for allowing the conveying arrangement 4 to be assembled and mounted semiautomatically and is thus arranged for setting up the packaging machine 100 for production.

The conveying arrangement 4 is introduced separately inside the cabin 3, using a further transferring unit 50' that can be removably locked to the apparatus 1 in a hooking position K, in which the operating chamber 30 of the cabin 3 is in communication with the internal chamber 51' of the further transferring unit 50', by previously opening the access 31.

For this reason the apparatus 1 may comprise an attaching arrangement 68 arranged for coupling with a joining arrangement 58 of transferring unit 50' in such a way as to lock the latter to the access 31. The joining arrangement 58 comprises, for example, one or more threaded bolts arranged for being inserted and tightened in respective threaded seats of the attaching arrangement 68 of the apparatus 1 (FIG. 11).

The further transferring unit 50' comprises a first transferring device 54 and a second transferring device 55 for supporting and moving respectively the feeding pipe 13 and the storing pipe 14. The connecting arrangement 16 can be previously assembled with the respective second end portion 14*b* of said storing pipe 14.

The transferring devices 54, 55 are movable between respective internal positions, in which the feeding pipe 13 and the storing pipe 14 are contained in the transferring unit 50' and respective external positions, in which the aforesaid pipes 13, 14 are introduced into the cabin 3 of the apparatus.

The transferring devices 54, 55 can be driven manually by the operators, for example through respective openings for gloves 52' provided in the further transferring unit 50', or automatically, through a driving device, for example electric motors.

An housing element 45, which is arranged for receiving and supporting the feeding pipe 13, is previously fixed to wrist 6 of lifting arrangement 2.

One or more operators, who work through corresponding openings for gloves 33, transfer the feeding pipe from the first transferring device 54 to the housing element 45 manually.

Similarly, the operators remove the storing pipe 14 from second transferring device 55 and connect it to the feeding pipe 13. The connecting arrangement 16 is fixed to the respective second end portion 13*b* of connecting pipe 13.

In order to facilitate the aforesaid connection, the feeding pipe 13 can be provided with reference pins, which abut seats made in the storing pipe 14 or in the connecting arrangement 16.

At this point, arm 5 and wrist 6 of lifting arrangement 2 can be driven in such a way as to lift the conveying arrangement 4 along a vertical lifting direction L, i.e. orthogonal to the sustaining plane 90, so as to transfer it from a respective picking position W to a first upper position E.

At this first upper position E, conveying arrangement 4 is connected to a second moving arrangement 60 of the apparatus 1, in order to allow the disengagement of lifting arrangement 2 and the descent of arm 5.

Second moving arrangement 60 is movable along a respective sliding direction M, in such a way as to transfer conveying arrangement 4 from the first upper position E to a second upper position F.

Said sliding direction M is almost parallel to the sustaining plane 90 and orthogonal to the lifting direction S of the vibrating supporting device 15.

The second moving arrangement 60 comprises, for example, a second carriage 61 that is slidable by means of rollers 65 on a longitudinal sliding guide 62 fixed to a further supporting frame 34 of the apparatus 1.

Second carriage 61 has a first hooking element 63 that is configured for coupling with a corresponding second hooking element 64 provided on the feeding pipe 13. The hooking elements 63, 64 have, for example, "tri-clamp" attachments.

The second moving arrangement 60 can be moved manually by an operator or can be automatically moved. In this case, a suitable motor is provided for driving the second carriage 61.

In the second upper position F, the vibrating supporting device 15, positioned by first moving arrangement 66 in a respective raised position H, abuts conveying arrangement 4. In this position, the connecting pipe 13 is engaged with a supporting element 67 of vibrating supporting device 15, to which it can be removably locked, for example using threaded knobs or suitable clamps.

After being fixed to the vibrating supporting device 15, the feeding pipe 13 can be uncoupled and separated from second moving arrangement 60.

First moving arrangement 66 when driven causes the descent of vibrating supporting device 15 to a lowered position N, for the connection of conveying arrangement 4 to the dosing unit 101 of the packaging machine 100, in a connecting position G.

In particular, as shown in FIGS. 9 and 10, first moving arrangement 66 during the descent rotates the vibrating supporting device 15 and therefore the conveying arrangement 4 by an angle such as to enable the first end portion 13*a* of feeding pipe 13 to be inserted into an upper opening of the hopper 101*a* of dosing unit 101.

The rotation amount is correlated both to dimensions and shape of feeding pipe 13 and of storing pipe 14 and to the position of packaging machine 100 and of respective dosing unit 101.

In the connecting position G, conveying arrangement 4 is thus arranged for receiving a barrel 200 or a bag 300 so as to discharge the product inside the hopper 101*a*.

It should be observed that apart from the operation of coupling/uncoupling the conveying arrangement 4 to/from the second moving arrangement 60 and to/from the vibrating supporting device 15, conveying arrangement 4 is moved automatically from the respective picking position W to the connecting position G by lifting arrangement 2 and by first moving arrangement 66, without direct and manual interventions by operators, thus simplifying and accelerating the whole assembly sequence. By repeating the aforesaid procedures in reverse order, it is possible to dismantle the conveying arrangement 4, which can be returned in the respective picking position W.

In this position, conveying arrangement 4 can be dismantled in such a way as to enable the operators to position the feeding pipe 13 and the storing pipe 14 with the connecting arrangement 16 respectively on the first transferring device 54 and on the second transferring device 55 of transferring unit 50.

The first supporting arrangement 7 and the second supporting arrangement 22, which have to be fixed to the wrist 6 of lifting arrangement 2 according to the product container to be used, can be introduced and/or removed from the cabin 3 of apparatus 1 using the same transferring unit 50' used for conveying the conveying arrangement 4.

Figure 13:
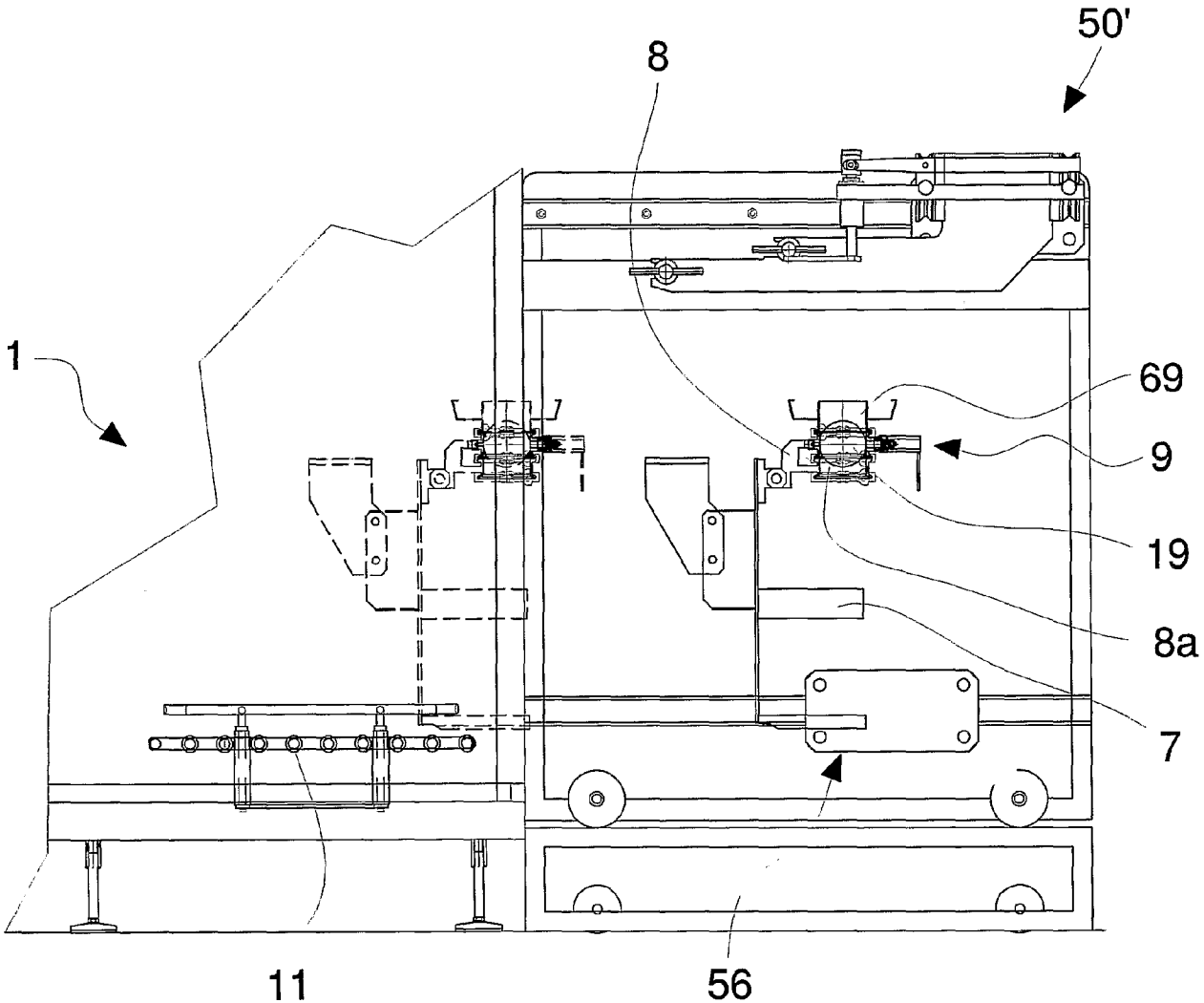
FIG. 13 is a schematic front view of the apparatus in association with a further transferring unit, showing the supporting arrangement of the first product container in various steps of introduction into the apparatus.

For this reason, transferring unit 50' may comprise a third transferring device 56 suitable for supporting and moving the first supporting arrangement 7 and which is movable in such a way as to introduce, at least partially, said first supporting arrangement 7 onto the second sustaining plane 11 (FIG. 13).

The third transferring device 56 can be driven manually by one or more operators through the openings for gloves 52 provided on transferring unit 50.

Alternatively, third transferring device 56 can be moved by respective driving device, for example electric motors.

Once first supporting arrangement 7 is arranged on the second sustaining plane 11, it is then moved in a rectilinear manner on the first sustaining plane 10 at the lifting arrangement 2, which is arranged in the lower position C, in such a way as to be fixed to the wrist 6.

Figure 14:
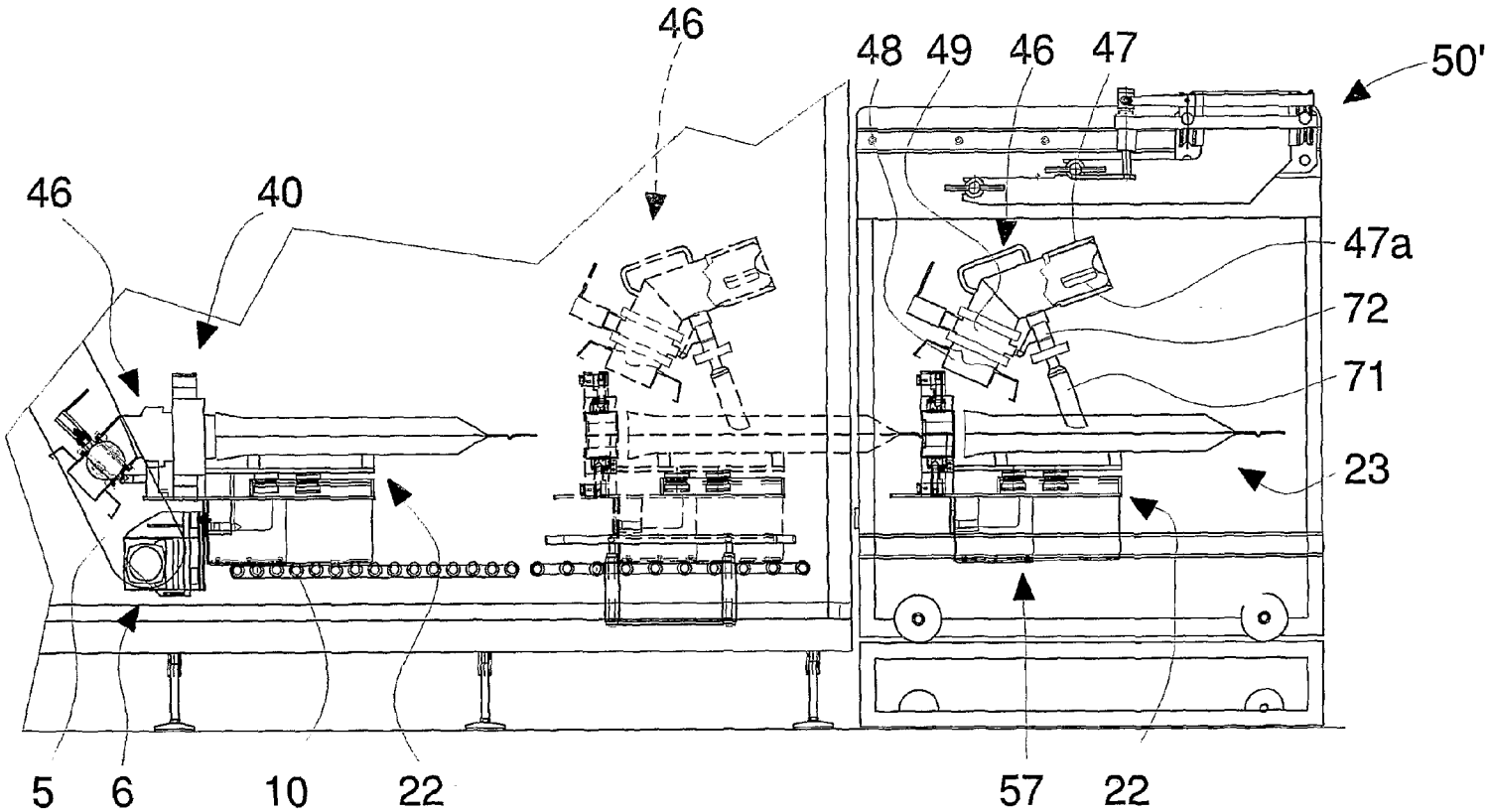
FIG. 14 is a view like the one in FIG. 13, showing the supporting arrangement of the second product container in steps of introduction into the apparatus.

At this point, lifting arrangement 2 is arranged for receiving a product barrel 200. If the packaging machine 100 has to be fed using bags of product 300, the transferring unit 50' may comprise a fourth transferring device 57 suitable for supporting and moving the second supporting arrangement 22. The fourth transferring device 57 is movable in such a way as to introduce, at least partially, second supporting arrangement 22 inside the cabin 3, on the second sustaining plane 11 (FIG. 14).

The second fitting arrangement 46, which is also to be introduced inside the cabin 3 of the apparatus 1, is further fixed to the second supporting arrangement 22. For this reason, enclosure arrangement 23 is provided with a first connecting element 71 configured for coupling with a second connecting element 72 fixed to the second fitting arrangement 46. Connecting elements 71, 72 have, for example, "tri-clamp" attachments.

Connecting element 71 is for example a pin with a tri-clamp attachment fixed to the upper part 24 of the enclosure arrangement 23.

The fourth transferring device 57 can be driven manually by one or more operators through the openings for gloves 52 present on the transferring unit 50 or, alternatively, through respective driving device, for example electric motors, connected to said third transferring device 56.

Once the second supporting arrangement 22 is arranged on the second supporting plane 11, it is moved onto the first sustaining plane 10 at the lifting arrangement 2, arranged in the lower position C, in such a way as to be connected to the wrist 6. The second fitting arrangement 46 can be detached from the enclosure arrangement 23 and then fixed to the supporting element 28.

At this point, lifting arrangement 2 is arranged for receiving and moving a product bag 300.

As shown in FIG. 10, the housing element 45 of conveying arrangement 4 is positioned, when not in use, inside the apparatus 1 and is moved and fixed to the wrist 6 when necessary.

The apparatus 1 according to the invention further enables the powder product, which is inside the conveying arrangement 4, to be recovered in the case of a stop of packaging machine 100.

For this reason, actuating devices 17, 18 closes the valves 19, 49 of fitting arrangement 9, 46 and the adjusting device 20 of connecting arrangement 16.

Storing pipe 14 is then fixed to the wrist 6 of the lifting arrangement 2 by means of a suitable bracket that is of known type and is not shown and connecting arrangement 16 is detached from the feeding pipe 13.

At this point, the wrist 6 is rotated clockwise by a preset angle until the container 200, 300 is taken to a vertical position with the opening 201, 301 facing upwards. The valves 19, 49 is then opened manually to enable the powder contained inside the storing pipe 14 to slide into the container 200, 300. In order to facilitate this operation, the vibrating device 74 of the wrist 6 is activated.

After a preset period of time has elapsed, the vibrating device 74 is deactivated and the valve 19, 49 is closed manually.

The wrist 6 is rotated so as to return the container 200, 300 to the feeding position B, B' for enabling a subsequent connection of connecting arrangement 16 to the connecting pipe 13.

After the connecting arrangement 16 is coupled to the connecting pipe 13 and the storing pipe 14 is detached from the wrist 6, the second actuating device 18 opens the adjusting device 20 and vibrating supporting device 15 is activated for a preset period of time.

In this way, powder product, which can remain inside the conveying arrangement 4, is conveyed inside the feeding tank 101*a* of dosing unit 101.

The invention claimed is:

1. Apparatus for feeding a product to be packaged to a packaging machine provided with a dosing unit, the apparatus comprising:

a lifting arrangement suitable for lifting and moving at least a container of said product from a picking position to a feeding position in such a way as to connect said container to said dosing unit to transfer thereto the product contained in said container; and a containing element enclosing said lifting arrangement and defining an operating space that is substantially insulated and airtight, wherein in the feeding position, an opening of said container is connected to the dosing unit by means of a conveying arrangement comprising a feeding pipe connected to the dosing unit, a storing pipe connected to the container and an adjusting device for hermetically sealing an internal passage between the storing pipe and the feeding pipe, the adjusting device being configured to allow in the feeding position adjusting the product sliding from the storing pipe, and wherein the operating space is practically isolated and separated from an environment in which the packaging machine is positioned, wherein said lifting arrangement comprises an elongated arm that is rotatably connected to a supporting frame and rotatably supports a connecting member, said elongated arm and said connecting member being rotatable respectively around a first rotation axis and around a second rotation axis that are substantially parallel, the apparatus further comprising a supporting arrangement removably coupleable with said connecting member and suitable for receiving and supporting said container, said supporting arrangement comprising a first supporting arrangement configured for receiving and supporting a first container having the shape of a drum or a barrel and a second supporting arrangement configured for receiving and supporting a second container having the shape of a bag, wherein said second supporting arrangement comprises a supporting element that is removably coupleable with said connecting member and slidably supports an enclosure arrangement, arranged for receiving and containing said second container.

2. Apparatus according to claim 1, wherein said enclosure arrangement comprises an upper part and a lower part, which are superimposable in a closing condition and are provided with respective cavities that are suitable for forming in said closing condition an internal housing that is arranged for containing and enclosing a central portion of said second container.

3. Apparatus according to claim 2, wherein said upper part and said lower part are configured for forming a passage through which a neck portion of said second container can exit.

4. Apparatus according to claim 1, wherein said upper part and said lower part comprise respective end portions suitable for clamping a bottom portion of said second container to lock the second container inside the enclosure arrangement.

5. Apparatus according to claim 2, wherein said upper part and said lower part are rotatably connected along a longitudinal edge by hinges.

6. Apparatus according to claim 3, comprising an opening arrangement fixed to said second supporting arrangement and suitable at least for detaching opposite flaps of said second container, at said neck portion, on which an opening cut was made, in such a way as to form an opening of said second container.

7. Apparatus according to claim 4, wherein said opening arrangement comprises a first suction cup and a second suction cup that are movable between an adhesion position, wherein they substantially abut on one another and adhere to external surfaces of said opposite flaps of said second container, and a detachment position, wherein said first suction cup and said second suction cup are spaced apart from one another so as to separate and move apart said opposite flaps and form the opening of said second container.

8. Apparatus according to claim 6, wherein said opening arrangement comprises an abutting element arranged around said neck portion and configured for abutting said opposite flaps that are separated and widened by the first suction cup and the second suction cup in the detachment position in such a way as to shape said opening.

9. Apparatus according to claim 1, wherein said containing element comprises an access for introducing into and/or removing from said operating space at least said container.

10. Apparatus according to claim 9, wherein said access comprises an opening and is closable by means of a door.

11. Apparatus according to claim 1, wherein said containing element has side walls provided with a plurality of openings for gloves.

12. Apparatus according to claim 1, comprising a ventilation device arranged in an upper portion of said containing element and suitable for generating and directing a monodirectional flow of filtered air inside said operating space.

13. Apparatus according to claim 12, wherein said ventilation device comprises a fan and a filter arrangement.

14. Apparatus according to claim 9, comprising a sustaining arrangement suitable for slidably supporting at least said container and interposed between said lifting arrangement and said access.

15. Apparatus according to claim 1, wherein said supporting frame is fixed to said packaging machine, said apparatus further comprising a driving arrangement suitable for moving said arm and said connecting member.

* * * * *